US006783613B1

(12) United States Patent
Gill et al.

(10) Patent No.: US 6,783,613 B1
(45) Date of Patent: Aug. 31, 2004

(54) MODIFIED POLYBUTADIENE POLYMERS THAT ARE BOTH CHEMICALLY DEGRADABLE AND PHYSICALLY COMPATIBLE WITH ENERGETIC PLASTICIZERS FOR USE IN PROPELLANT AND EXPLOSIVE BINDERS

(75) Inventors: Robert C. Gill, White Plains, MD (US); Horst G. Adolph, Warrenton, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 122 days.

(21) Appl. No.: 10/118,616

(22) Filed: Apr. 4, 2002

(51) Int. Cl.[7] ..... C06B 45/10

(52) U.S. Cl. ..... 149/19.1; 149/19.4; 149/19.6; 149/88; 528/279; 526/335

(58) Field of Search ..... 149/19.1, 19.4, 149/19.6, 88; 528/279; 526/335

(56) References Cited

U.S. PATENT DOCUMENTS 6,362,311 B1 * 3/2002 Highsmith et al. ..... 528/409

* cited by examiner

*Primary Examiner*—Robert D. Harlan
(74) *Attorney, Agent, or Firm*—Mark Homer

(57) ABSTRACT

The present invention is a modified HFPB polymer for use in propellants and explosives that is chemically degradable and also is compatible with commonly used energetic plasticizers. The HFPB polymer of the present invention contains ester linkages formed in the backbone of the polymer from a dicarboxylic acid containing either oxymeythylene or oxyethylene moeities. The ester and ether linkages change the polarity of the polybutadiene to make it compatible with polar energetic plasticizers. The ester linkages along with either oxymethylene or oxyethylene moeities make the polymer degradable to basic solutions while still maintaining the structural integrity necessary for a polybutadiene type binder.

11 Claims, No Drawings

MODIFIED POLYBUTADIENE POLYMERS THAT ARE BOTH CHEMICALLY DEGRADABLE AND PHYSICALLY COMPATIBLE WITH ENERGETIC PLASTICIZERS FOR USE IN PROPELLANT AND EXPLOSIVE BINDERS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to the field of propellants and explosives, more particularly to hydroxy terminated polybutadiene (HTPB) based binders for energetic materials, and most particularly to hydroxy functionalized polybutadiene (HFPB) based binders for energetic materials that possess improved compatibility with energetic plasticizers and are chemically degradable.

2. Brief Description of the Prior Art

Many solid propellant and explosive binders used today are reaction products of HTPB prepolymers. This is due to HTPB binders having excellent mechanical properties as discussed further below. These binders are often diluted with up to 40% inert plasticizers. Inert plasticizers do not carry energetic groups and their main purpose is to improve processability and the flexibility of the binder at low temperatures. However, these inert binders not only reduce performance of the propellant or explosive, but also require very high levels of oxidizer to effect complete combustion. Therefore, the use of energetic plasticizers is attractive in the preparation of solid propellants and explosives. The major problem with the use of energetic plasticizers with HTPB based prepolymers is the lack of compatibility. This is because the common energetic plasticizers, mainly high energy nitrato- or nitro-compounds, are not soluble to any significant extent in HTPB prepolymers. The major focus to solving this problem has been the development of new energetic plasticizers that are more compatible with HTPB prepolymers. One example is U.S. Pat. No. 5,578,789 that discloses an energetic plasticizer that is a polybutadiene compatible nitrato-derivative of aliphatic hydrocarbons. However, none of these new energetic plasticizers have overcome the performance or cost issues necessary to become widely used. In view of the above discussion, it is desired to produce a new polybutadiene based polymer that is more compatible with common energetic plasticizers used in solid propellant and explosive formulations.

As noted above, HTPB based binders are widely used due to good mechanical properties and long shelf life. This is the result of the insoluble binder network formed from the HTPB prepolymer. One drawback of such an insoluble binder is that it does not allow for the reclamation of the energetic ingredients and hardware after the shelf life of the propellant or explosive has expired. Therefore, it is also desired to produce a polybutadiene based binder that is chemically degradable, in particular by hydrolysis, solvolysis, or similar chemical reactions.

SUMMARY OF THE INVENTION

The present invention is a modified HFPB polymer for use in propellants and explosives that is chemically degradable and also is compatible with commonly used energetic plasticizers.

Accordingly it is an object of this invention to provide a modified polybutadiene polymer that can be used in a binder for explosives and propellants.

It is a further object of this invention to provide a polybutadiene type polymer that is compatible with energetic plasticizers commonly used in propellant and explosive formulations.

It is yet a further object of this invention to provide a polybutadiene type polymer that can be used in a binder that is chemically degradable.

This invention accomplishes these objectives and other needs related to polybutadiene based polymers used for explosive and propellant binders by providing a HFPB polymer that contains ester linkages formed in the backbone of the polymer from dicarboxylic acids containing either oxymethylene or oxyethylene moeities. The ester and ether linkages change the polarity of the polybutadiene to make it compatible with polar energetic plasticizers. The ester linkages along with either the oxymethylene or oxyethylene moeities make the polymer degradable by basic or acidic polar liquids while still maintaining the structural integrity necessary for a polybutadiene type binder. The invention also includes a process for producing the HFPB polymer described herein.

DESCRIPTION OF THE PREFERRED EMBODIMENT

The present invention comprises a HFPB polymer for use in propellants and explosives to replace the standard HTPB polymers used in preparing binders for these propellants and explosives, As noted above, standard HTPB binders are generally incompatible with common energetic plasticizers. The HFPB polymers of the present invention maintain all of the preferred properties of standard HTPB binders and are compatible with common energetic plasticizers. Only minor changes in processing procedures for propellants and explosives will allow the replacement of standard HTPB polymers with the polymers of the present invention.

At the end of the life cycle of current propellants and explosives, it is becoming more attractive, from both cost and environmental perspectives, to recycle the energetic ingredients and hardware. With current HTPB binders, this is not possible. The present invention allows one to degrade the propellant or explosive to accomplish this recycling.

The general formula for the HFPB polymers of the present invention follows:

(HO)-POLYBUTADIENE-O(O)C-R-C(O)O-POLYBUTADIENE-(OH)

The polymer comprises a functionality of from 2 to 3 and the ester within the backbone of the polymer is an ester of a diacid. As noted above, the polymer readily degrades under basic conditions. Also, as noted above, energetic plasticizers are soluble in the polymers of this invention because the ester and ether linkages increase the polarity of the polybutadiene based polymer to approach the polarity of the energetic plasticizer. Therefore, these polymers will really hold an energetic plasticizer in order to make an energetic binder for a propellant or explosive.

The general method of preparing the present invention is through esterfication of a hydroxy-functionalized polybutadiene polymer with a diacid in a molar ratio of 2 to 1. This results in the general HFPB-ester-HFPB structure disclosed above. This is further described via the following equation:

2(OH)-POLYBUTADIENE-OH+HO(O)C-R-C(O)OH→(HO)POLYBUTADIENE-O(O)C-R-C(O)O-POLYBUTADIENE-(OH)

The diacid selected for the above reaction may vary widely, depending upon the particular use of the final product. However, in order to achieve adequate degradability as well as polarity, it is preferred that R contain oxyethylene or oxymethylene moieties. However, other structures of R may be selected due to other considerations, for example, compatibility with specific energetic plasticizers.

One preferred diacid for use in the preparation of the present invention is a dicarboxylic acid. Preferred dicarboxylic acids include diglycolic acid, 3,6,9-trioxaundecanedioic acid, polyethyleneglycoldiacetic acid, or mixtures thereof.

As can be seen by the examples set forth below, preferred embodiments of the present invention comprise a molecular weight comprising from about 2000 to about 10,000. However, this will vary dependent upon the molecular weight of the HFPB prepolymer and of the diacid selected to prepare the polymers of the present invention.

The present invention also includes a process of making a modified hydroxy-functionalized polybutadiene polymer that is chemically degradable and is compatible with energetic plasticizers. The first step is to prepare a solution of the HFPB prepolymer, a diacid, and a catalyst in a solvent. The preferred solvent is dichloromethane and a preferred catalyst is a dimethylaminopyridine tosylate. Next, it is preferred that the solution be deoxygenated with ferrous sulfate. After drying the solution, it is reacted with dicyclohexylcarbodiimide. The product polymer is then separated from the precipitated solids. The product polymer is then purified by treatment with a weak acid and a weak base. Finally, the product polymer is isolated by removing the solvent, normally in vacuo. Specific descriptions of this general process are shown in examples 1–4 below.

The general nature of the invention having been set forth, the following examples are presented as specific illustrations thereof. It will be understood that the invention is not limited to these specific examples, but can be practiced with various modifications that will be recognized by one of ordinary skill in the art.

EXAMPLE 1

Diester HGA 1/81-1 prepared from hydroxy-functionalized polybutadiene (MW 1200, HFPB 1200) and polyethyleneglycoldiacetic acid (MW 600). A 100 ml three-neck flask fitted with a nitrogen inlet tube, a drying tube (Drierite), and a magnetic stirring bar was flushed with a slow stream of dry nitrogen. The following were placed in a flask during stirring: 12.24 g of HFPB 1200 (Aldrich catalog #38,766-5), 3.0 g of polyethyleneglycoldiacetic acid (FLUKA catalog #81324, MW ca. 600), and 30 ml of dichloromethane. Next the dichloromethane was distilled off under nitrogen up to a bath temperature of 65° C. After cooling the mixture, 0.29 g of 4-dimethylaninopyridine monotosylate and 30 ml of dichloromethane (previously dried over 4A molecular sieves) were added, and the dichloromethane was distilled off as before. This resulting mixture was cooled in an ice bath with stirring after 10 ml more of the dried dichloromethane had been added, and then 11 ml of a 1 molar solution of dicyclohexylcarbodiimide in dichloromethane was added dropwise. The mixture was then stirred at room temperature, under nitrogen, for 48 hours. 0.5 ml of water was added and the stirring continued for another 0.5 hours. After this, the mixture was then chilled in the freezer, filtered with suction through a Buechner funnel, and the solids were washed twice with small amounts of chilled dichloromethane. The filtrate was mixed for 15 min with 25 ml of a 1% aqueous solution of sulfuric acid, the phases were separated, the dichloromethane solution was stirred for 15 min with 1 g of sodium hydrogen carbonate, then with magnesium sulfate and it was then filtered. The solvent was removed in vacuo (ca. 1 torr) at a temperature of 50° C. or less. Obtained was 15.0 g (100%) of a turbid oil. The GPC showed Mn ca. 3000 (PEG calibration). 1H NMR (CDCL3): δ 2.03 s; 3.64 s; 5.38 s; multiplets near 1.3; 4.1; 4.9. DSC (20° C./min): T(g) −58° C.; no other transitions to 50° C.

EXAMPLE 2

Diester HGA 1/85-2 prepared from hydroxy-functionalized polybutadiene (HFPB 1200) and diglycolic acid. Materials used were 18.0 g HFPB 1200, 1.0 g diglycolic acid, 30 ml dichloromethane, 0.45 g DMAP tosylate, 30 ml dichloromethane, and the procedure of example 1 was used thru the second drying step (distillation of dichloromethane). 20 ml of tetrahydrofuran, dried over 4A molecular sieves, was then added with continued stirring and cooling in an ice bath. 16.5 ml of a 1M solution of dicyclohexylcarbodiimide in dichloromethane was added to the reaction mixture, and the mixture was stirred a room temperature for 48 hours. Again, the workup procedure of example 1 was followed, but after the dicyclohexylurea had been filtered off, the filtrate was freed of solvents in vacuo and the residue was dissolved in ca. 25 ml of dichloromethane and the solution subjected to the sulfuric acid and the sodium hydrogen carbonate treatment described in example 1. It was then dried with magnesium sulfate and filtered. The solvents were removed as described in example 1, residual tetrahydrofuran being monitored by 1H NMR. Obtained was 19.35 g of an oil containing small amounts of tetrahydrofuran and dicyclohexylurea (100% of pure compound would have been 18.45 g). The GPC of this material showed Mn ca. 2550.

1H NMR (CDCL3): δ 2.03 s; 5.40 s; multiplets near 1.3; 4.9. DSC (20° C./min): T(g) −69° C.; no other transitions to 50° C.

EXAMPLE 3

Diester HGA 1/86-2 prepared from hydroxy-functionalized polybutadiene (HFPB 1200) and 3,6,9-trioxaundecanedioic acid. The procedure of example 1 was used, with 114.50 g of HFPB 1200, 9.86 g of trioxaundecanedioic acid (FLUKA catalog #92893, purity 90%, effective molecular weight 207), 100 ml of dichloromethane, 2.86 g of DMAP monotosylate, 100 ml of dichloromethane, 80 ml of dichloromethane (dried over 4A molecular sieves), and 105 ml of a 1M solution of dicyclohexylcarbodiimide in dichloromethane. After sting at room temperature for 42 hours, the reaction mixture was worked up according to example 1, using 3 ml of water, 150 ml of a 1% aqueous sulfuric acid containing 2 g of ferrous sulfate, then 6 g of sodium bicarbonate, and then magnesium sulfate. The dried solution was filtered through a coarse sintered glass funnel and freed of solvent as described in example 1. Obtained was 128.5 g of a light brown, viscous liquid. The GPC showed Mn ca. 3000.

1H NMR (CDCL3): δ 2.04 s; 5.42 s; multiplets near 1.3; 3.7; 4.1; 4.9. DSC (20° C./min): T(g) −66° C.; no other transitions to 50° C.

EXAMPLE 4

Diester HGA 3/8 from hydroxy-functionalized polybutadiene (HFPB 1200) and 3,6,9-trioxaundecanedioic acid (improved procedure).

A 2 L three-neck flask fitted with a mechanical stirrer is purged with dry nitrogen and charged with 200 mL of dry (4A sieves) dichloromethane, 4.74 g of 4-dimethylaminopyridine, and 7.40 g of p-toluenesulfonic acid hydrate, and the mixture is stirred until the solids are dissolved.

Trioxaundecanedioic acid (FLUKA catalog #92893, purity 90%, effective molecular weight 207), 39.44 g, HFPB 1200, 458 g, and 750 mL of dry dichloromethane are added, and the mixture is stirred until homogeneous. 8 g of finely ground ferrous sulfate heptahydrate is added, the mixture is stirred for 1 hour, 10 g of magnesium sulfate is added, and the mixture is stirred again for 1 hour.

With continued stirring, the mixture is cooled in an ice-water bath and 440 mL of a 1M solution of dicyclohexylcarbodiimide in dichloromethane is added slowly. The mixture is then stirred for 48 hours at room temperature.

Water, 15 mL, is added and the mixture is stirred vigorously for 0.5 hours. The mixture is cooled in an ice-water bath for 1 hour and filtered through a large Buechner or coarse sintered glass funnel. The solids are washed with a total of 1 L of cold dichloromethane. The combined dichloromethane solutions are stirred for 15 minutes with 600 mL of 1% sulfuric acid containing 8 g of ferrous sulfate heptahydrate. The phases are separated and the aqueous phase is washed with 250 mL of dichloromethane.

The combined dichloromethane solutions arc stirred with 24 g of sodium hydrogencarbonate for 15 minutes, then stirred with magnesium sulfate to dry. The solution is filtered again through a coarse sintered glass funnel and 2.45 g of stabilizer AO 2246 is added. The solution is concentrated on a rotary evaporator at 50° C. Most of the remaining dichloromethane is removed at ca. 1 Torr and 60° C. for 1 hour on a rotary evaporator.

The GPC and the 1H NMR spectrum of the material were identical with those of example 3 above.

TESTS CONDUCTED TO DEMONSTRATE INVENTION OBJECTIVES

A. Curing and Aging Tests

These tests were performed to show that the modified HFPB polymers of this invention could be cured under the same conditions as standard HTPB and would form stable gumstocks, and to prepare test material for degradation and plasticization tests.

Gumstocks were prepared from polymers 1/81, 1/85, 1/86, and from the standard HTPB polymer R45M, using the common binder ingredients shown in Table 1. The binder mixes were all cured in a 60 C oven for 7 days, and then examined to ascertain if complete cure had occurred. All compositions 1–10 and 1C and 6C were found to be completely cured under these conditions.

TABLE 1

| Ingredient | Gumstock Compositions (g) | | |
|---|---|---|---|
| | Comp. 1 | Comp. 2 | Comp. 3 |
| Polymer 1/81-1 | 2.646 | 2.337 | 2.662 |
| DOA | 1.000 | 0.995 | 0.995 |
| CAPA 316 | — | 0.070 | 0.079 |
| HX-752 | — | 0.010 | 0.010 |
| DDI | — | 0.578 | — |
| N-100 | 0.354 | — | — |
| IPDI | — | — | 0.244 |
| TPB | 0.010 | 0.010 | 0.010 |

TABLE 1-continued

| Ingredient | Gumstock Compositions (g) | | |
|---|---|---|---|
| | Comp. 4 | Comp. 5 | Comp. 8 |
| Polymer 1/85-2 | 3.746 | 4.300 | 1.000 |
| ButylNENA | — | — | 1.000 |
| CAPA 316 | 0.134 | — | — |
| DDI | 1.110 | — | — |
| N-100 | — | 0.690 | 0.245 |
| TPB | 0.010 | 0.010 | 0.001 |
| | Comp. 6 | Comp. 7 | Comp. 9 |
| Polymer 1/86-1 | 2.613 | 2.774 | 1.000 |
| DOA | 1.000 | 1.000 | — |
| ButylNENA | — | — | 1.000 |
| AO 2246 | 0.026 | 0.028 | — |
| N-100 | 0.386 | — | 0.235 |
| IPDI | — | 0.225 | — |
| TPB | 0.001 | 0.001 | 0.001 |
| | Comp. 10 | Comp. 1C | Comp. 6C |
| Polymer 1/86-2 | 6.524 | — | — |
| R-45M | — | 4.563 | 8.639 |
| ButylNENA | 2.500 | 5.000 | — |
| 2-NDPA | 0.038 | — | — |
| AO 2246 | — | 0.044 | 0.086 |
| N-100 | 0.933 | 0.872 | 1.270 |
| TPB | 0.005 | 0.001 | 0.005 |

After the gumstocks had been cured, the were replaced in a 60 C oven and examined periodically to observe the effect of storage at elevated temperature on the gumstocks. All of the above gumstocks remained stable and showed no significant changes during 4 weeks at 60 C.

B. Degradation Tests

Degradation tests were conducted in acidic and basic media on the three polymers described in examples 1–3 and on gumstocks prepared from the polymers HGA 1/81-1 and HGA 1/86-1 (identical to HGA 1/86-2, described in example 3, but a different batch). Degradation tests were also run on a gumstock from standard HTPB polymer R-45M for comparison purposes. The results of these tests are shown in Table 2.

TABLE 2

Degradation of Test Material in Methanol/Water (9:1) Containing Hydrochloric Acid or Ammonia, Respectively (Tested at Room Temperature (25° C.) Unless Stated Otherwise)

| Test Conditions | | 2 hrs/ 0.1N HCL | 4 hrs/ 1.65N NH3 | 108 hrs/ 1.65N NH3 |
|---|---|---|---|---|
| Polymer | | | | |
| HFPB/PEG diacid ester | 1/81-1 | 20 | 75 | 90 |
| HFPB/diglycolic acid ester | 1/85-2 | 16 | 26 | — |
| HFPB/3,6,9-trioxaundecanedioic acid ester | 1/86-2 | 16 | 63 | — |
| Gumstock | | | | |
| Comp. 1, polymer | 1/81-1 | 100% degraded in ca. 48 hrs* in 1.65N NH3 | | |
| Comp. 7, polymer | 1/86-1 | 100% degraded in ca. 48 hrs* in 1.65N NH3 | | |

TABLE 2-continued

| Degradation of Test Material in Methanol/Water (9:1) Containing Hydrochloric Acid or Ammonia, Respectively (Tested at Room Temperature (25° C.) Unless Stated Otherwise) | | | | |
|---|---|---|---|---|
| Test Conditions | | 2 hrs/ 0.1N HCL | 4 hrs/ 1.65N NH3 | 108 hrs/ 1.65N NH3 |
| Comp. 6C, polymer | R-45M | No degradation after 168 hrs at 70° C. in 1.65N NH3 | | |

*solvent was 1:1 methanol/tetrahydrofuran

The data above shows that the relative rates of degradation in both acidic and basic media increased with increasing number of ether moieties in the dicarboxylic acid component of polymers 1/81, 1/85, and 1/86. The rate of degradation of the polymer can, therefore, be tailored by the choice of the dicarboxylic acid. It is to be expected that extending the range of dicarboxylic acids beyond the specific examples disclosed in this application will allow further tailoring of the degradation rate. A binder gumstock, prepared from the state-of-the-art HTPB polymer R-45M, remained unchanged after 168 hours at 70° C. in the 1.65N NH3 solution.

C. Plasticization Tests

Table 3 shows the results of a study of energetic plasticizer retention by the HFPB ester polymers of this invention. The data shows significant retention of the energetic plasticizer ButylNENA by the HFPB ester polymers, while the standard HTPB polymer R-45M does not retain any Butyl NENA plasticizer. The plasticizer retention of the HFPB ester polymers can be improved by tailoring the structure of the diacid.

TABLE 3

| Plasticization Study | | | |
|---|---|---|---|
| Comp. # | Polymer | % Butyl NENA in Initial composition | % Butyl NENA retained in gumstock |
| 8 | 1/85-2 | 44.5 | 29.8 |
| 9 | 1/86-1 | 44.7 | 30.9 |
| 10 | 1/86-2 | 25.0 | 22.4 |
| 1C | R-45M | 47.8 | 0 (no plasticization) |

GLOSSARY

The following are a list of acronyms and descriptions for the materials used in the testing described above:

1/81-1 is a HFPB (1200)/PEG diacid (600) ABA diester copolymer with an approximate molecular weight of 3000.

1/85-2 is a HFPB/diglycolic acid ester copolymer with an approximate molecular weight of 2500.

1/86-1 is a HFPB/3,6,9-trioxaundecanedioic acid ester copolymer with an approximate molecular weight of 2600.

AO-2246 is 2,2'-methylene bis (4,6-di-tert-butylphenol). It is a light yellow powder.

Butyl NENA is N-n-butyl-N-(2-nitroxyethyl)nitramine. It is a red liquid containing 2-NDPA.

CAPA® 316 is a tetrafunctional e-caprolactone-pentaerythritol polymer manufactured by Solvay Interox of Houston, Tex. It is a slightly viscous, hazy liquid and has an equivalent weight of 254 g.

DOA is dioctyl adipate. It is a liquid of low viscosity and low volatility.

DDI Diisocyanate™ is made from a 36-carbon aliphatic dibasic acid. It is a clear, yellow liquid having an equivalent weight of 300 g.

HX-752 is the benzene 1,3-dicarboxylic acid diamide of 2-methylaziridine. It is a viscous liquid.

IPDI is isophorone diisocyanate. It is a thin, clear liquid.

N-100 is a polyfunctional isocyanate made from hexamethylene diisocyanate. It is a thick but pourable clear liquid.

2-NDPA is 2,2'-dinitrodiphenyl amine. It is a red powder.

TPB is triphenyl bismuth. It is a white solid.

What is described above are specific examples of many possible variations on the same invention not intended to limit the invention. The claimed invention can be practiced using other variations not specifically described above.

What is claimed is:

1. A hydroxy-functionalized polybutadiene polymer for use in propellants and explosives, comprising the formula:

(HO)-POLYBUTADIENE-OOC-R-COO-POLYBUTADIENE-(OH)

wherein the polymer comprises a functionality of from about 2 to about 3, R is a polar organic group having ether linkages, OOC-R-COO comprises an ester of a dicarboxylic acid, the polymer degrades in a basic solution, and energetic plasticizers arc soluble in the polymer.

2. The hydroxy-functionalized polybutadiene polymer of claim 1, wherein R comprises oxymethylene or oxyethylene moieties.

3. The hydroxy-functionalized polybutadiene polymer of claim 2, wherein the dicarboxylic acid is selected from the group consisting of diglycolic acid, 3,6,9-trioxaundecanedioic acid, polyethyleneglycoldiacetic acid, and mixtures thereof.

4. The hydroxy-functionalized polybutadiene polymer of claim 3, wherein the dicarboxylic acid comprises diglycolic acid.

5. The hydroxy-functionalized polybutadiene polymer of claim 3, wherein the dicarboxylic acid comprises 3,6,9-trioxaundecanedioic acid.

6. The hydroxy-functionalized polybutadiene polymer of claim 3, wherein the dicarboxylic acid comprises polyethyleneglycoldiacetic acid.

7. The hydroxy-functionalized polybutadiene polymer of claim 1, further comprising a molecular weight comprising from about 2000 to about 10,000.

8. The hydroxy-functionalized polybutadiene polymer of claim 1, formed by esterfication of hydroxy-functionalized polybutadiene with the dicarboxylic acid in a molar ratio of approximately 2 to 1.

9. The hydroxy-functionalized polybutadiene polymer of claim 1, wherein the base comprises a polar solvent.

10. The hydroxy-functionalized polybutadiene polymer of claim 9, wherein the basic solution comprises a solution of ammonia in methanol.

11. The hydroxy-functionalized polybutadiene polymer of claim 1, wherein the energetic plasticizer comprises N-n-butyl-N-(2-nitroxyethyl)nitramine.

* * * * *